US012523409B2

(12) United States Patent
Pozgay et al.

(10) Patent No.: US 12,523,409 B2
(45) Date of Patent: Jan. 13, 2026

(54) REFRIGERATOR APPLIANCE AND METHOD OF OPERATING THE SAME DURING A VACATION MODE

(71) Applicant: Haier US Appliance Solutions, Inc., Wilmington, DE (US)

(72) Inventors: Walter S. Pozgay, Louisville, KY (US); Ronald Gary Foster, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 97 days.

(21) Appl. No.: 18/647,483

(22) Filed: Apr. 26, 2024

(65) Prior Publication Data

US 2025/0334317 A1 Oct. 30, 2025

(51) Int. Cl.
*F25C 1/25* (2018.01)
*F25D 17/02* (2006.01)

(52) U.S. Cl.
CPC ..... *F25D 17/02* (2013.01); *F25C 1/25* (2018.01)

(58) Field of Classification Search
CPC ..... F25D 17/02; F25D 2600/02; F25C 1/25; F25C 2400/14; F25C 2600/02; G01M 3/2807; F17D 5/02
See application file for complete search history.

(56) References Cited

U.S. PATENT DOCUMENTS

| | | | | |
|---|---|---|---|---|
| 10,280,061 | B2 | 5/2019 | Ko et al. | |
| 11,095,960 | B2 | 8/2021 | Klicpera | |
| 2006/0027267 | A1* | 2/2006 | Fritze | F25D 23/126 62/189 |
| 2022/0026305 | A1 | 1/2022 | Rudd et al. | |
| 2022/0178784 | A1 | 6/2022 | Kyriacou | |

OTHER PUBLICATIONS

Samsung, "How to set the vacation mode or the lock function on my refrigerator?", accessed https://www.samsung.com/latin en/support/home-appliances/how-to-set-the-vacation-mode-or-the-lock-function-on-my-refrigerator/, published Jun. 9, 2021, 7 pages.

* cited by examiner

*Primary Examiner* — Cassey D Bauer
(74) *Attorney, Agent, or Firm* — Dority & Manning, P.A.

(57) ABSTRACT

A refrigerator appliance includes a cabinet, at least one sensor positioned within the cabinet, and at least one water valve positioned within the cabinet. A method of operating a refrigerator appliance includes determining the refrigerator appliance is operating according to a predetermined operating mode; detecting, via the at least one sensor, a flow of water within the refrigerator appliance; determining a length of time for which the water flows upon detecting the flow of water; determining that the length of time for which the water flows is greater than a first predetermined threshold length of time; and implementing a responsive action in response to determining that the length of time is greater than the first predetermined threshold length of time, wherein the responsive action includes emitting a notification to a remote connected device.

18 Claims, 4 Drawing Sheets

REFRIGERATOR APPLIANCE AND METHOD OF OPERATING THE SAME DURING A VACATION MODE

FIELD OF THE INVENTION

The present subject matter relates generally to domestic appliances, and more particularly to monitoring water supplies within refrigerator appliances.

BACKGROUND OF THE INVENTION

Refrigerator appliances typically include a cabinet forming one or more chilled chambers in which perishable items such as food, drinks, medications, and the like may be maintained at a temperature below ambient. Conventionally, refrigerator appliances are connected to power sources, such as municipal power sources to selectively or routinely drive a conditioning system such as a refrigeration system and an air flow system. Power is supplied to, for instance, a compressor to compress a refrigerant and circulate the refrigerant through an evaporator, an expansion device, and a condenser. Power is also supplied to a fan to circulate air over the evaporator to cool the air before supplying the air to the chilled chamber.

Refrigerator appliances may include municipal or external water supplies. For instance, some refrigerator appliances include built in automatic ice makers, in-door dispensers, or the like which may utilize external water sources. Existing refrigerator appliances exhibit drawbacks in terms of monitoring water supplies in certain operating modes. For instance, when a user is away for an extended period of time, such as a vacation, a water leakage or malfunction of equipment dealing with the water may occur without the user having knowledge thereof. Moreover, the user may be unaware of these leakages and unable to mitigate undesirable effects caused by such leakages.

Accordingly, a refrigerator appliance which obviates one or more of the above-mentioned drawbacks would be beneficial. In particular, a refrigerator appliance with improved detection and notification of water leakages would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet defining a fresh food chamber and a freezer chamber; at least one sensor positioned within the cabinet, the at least one sensor being configured to monitor a flow of water into the refrigerator appliance; at least one water valve positioned within the cabinet, the at least one water valve being adjustable between a closed position and an open position to selectively allow water into the refrigerator appliance; and a controller operably coupled with the at least one sensor, the controller being configured to perform an operation. The operation may include determining the refrigerator appliance is operating according to a predetermined operating mode; detecting, via the at least one sensor, a flow of water within the refrigerator appliance after determining the refrigerator appliance is operating according to the predetermined operating mode; determining a length of time for which the water flows upon detecting the flow of water; determining that the length of time for which the water flows is greater than a first predetermined threshold length of time; and implementing a responsive action in response to determining that the length of time is greater than the first predetermined threshold length of time, wherein the responsive action includes emitting a notification to a remote connected device.

In another exemplary aspect of the present disclosure, a method of operating a refrigerator appliance is provided. The refrigerator appliance may include a cabinet defining a fresh food chamber and a freezer chamber, at least one sensor positioned within the cabinet and configured to monitor a flow of water into the refrigerator appliance, and at least one water valve positioned within the cabinet. The method may include determining the refrigerator appliance is operating according to a predetermined operating mode; detecting, via the at least one sensor, a flow of water within the refrigerator appliance after determining the refrigerator appliance is operating according to the predetermined operating mode; determining a length of time for which the water flows upon detecting the flow of water; determining that the length of time for which the water flows is greater than a first predetermined threshold length of time; and implementing a responsive action in response to determining that the length of time is greater than the first predetermined threshold length of time, wherein the responsive action includes emitting a notification to a remote connected device.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
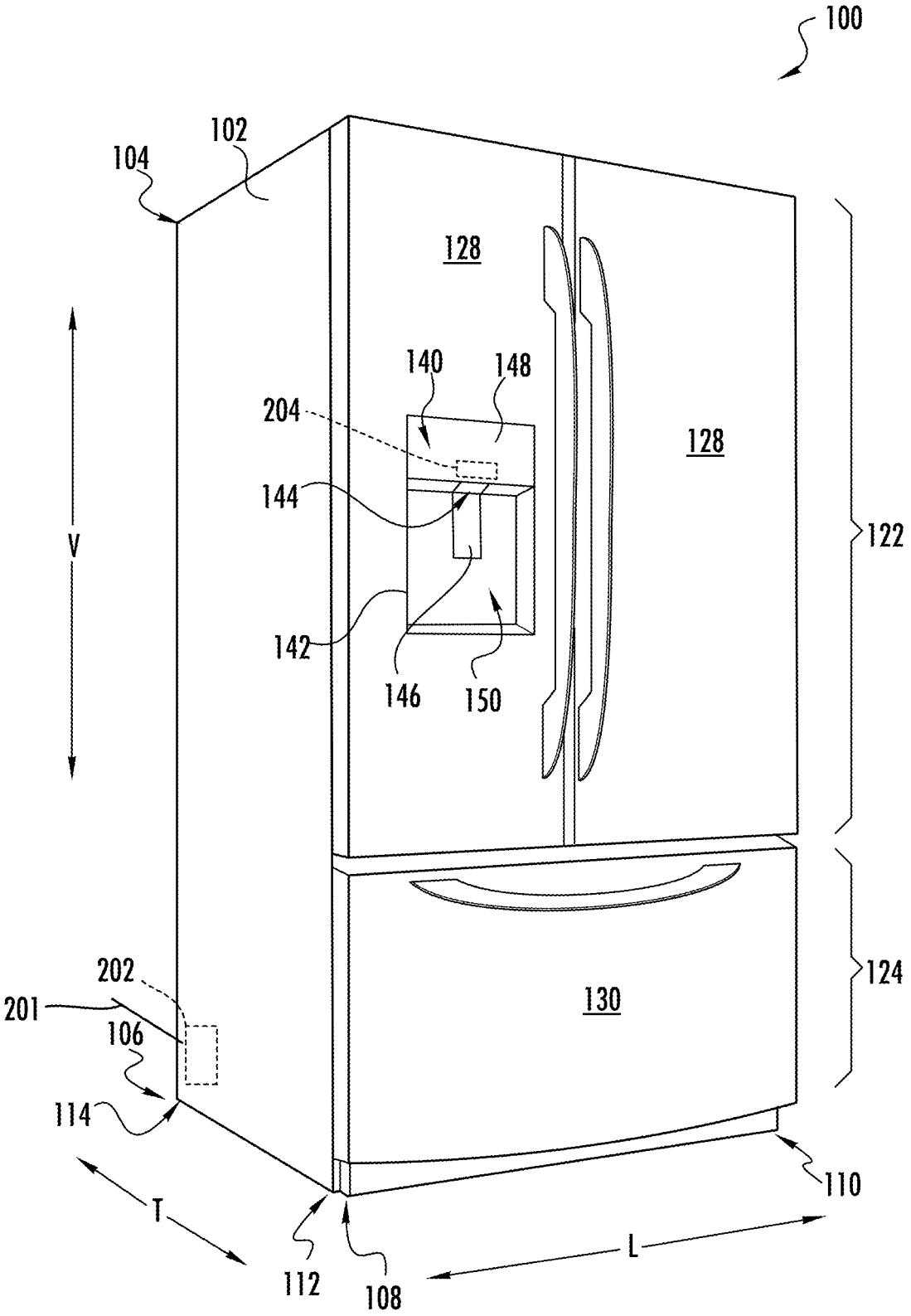
FIG. 1 provides a perspective view of a refrigerator appliance according to example embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Figure 2:
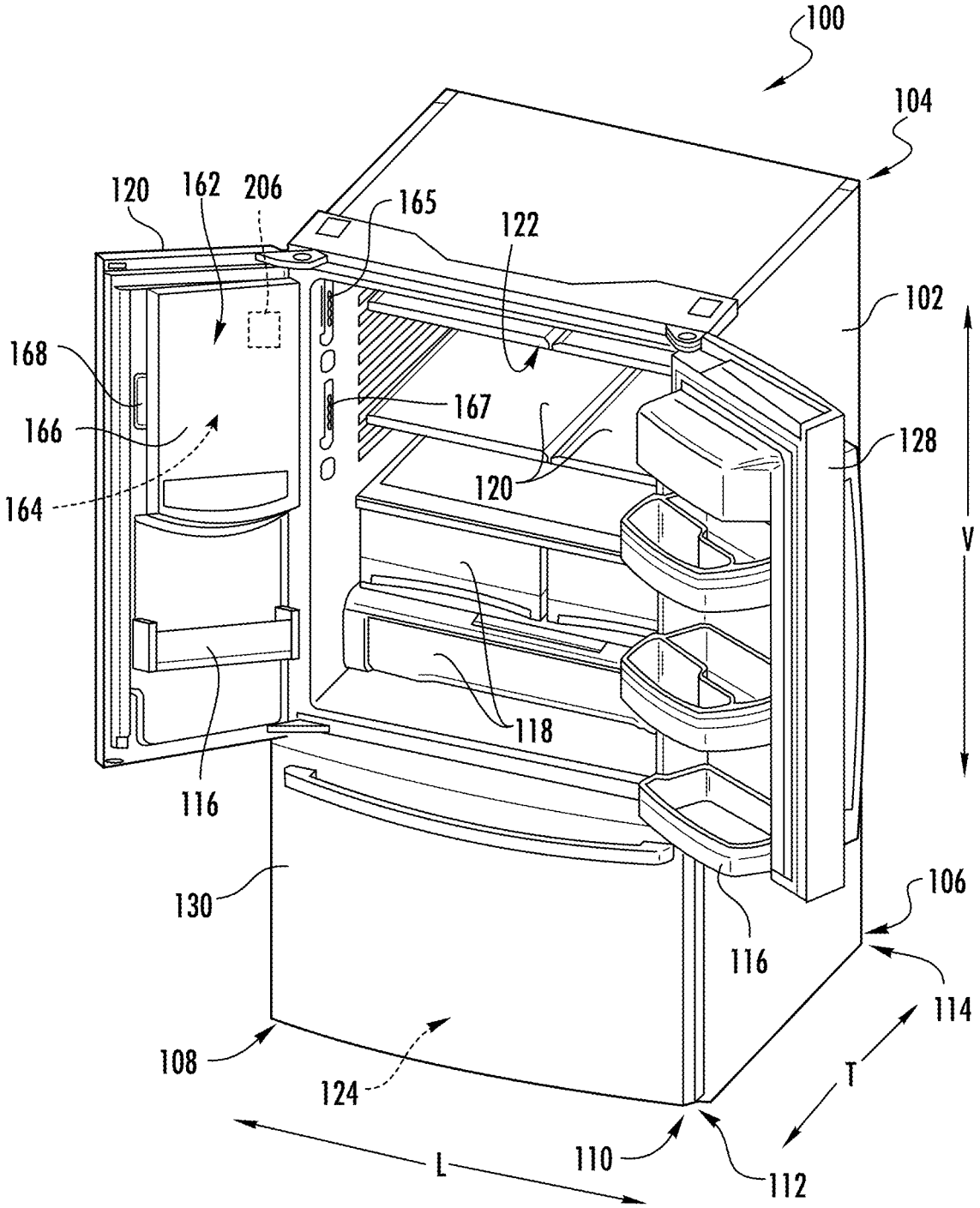
FIG. 2 provides a perspective view of a door of the example refrigerator appliance of FIG. 1.

Referring now to the figures, FIGS. 1 and 2 provide perspective views of a refrigerator appliance (e.g., refrigerator appliance 100) according to an exemplary embodiment of the present disclosure. As shown, refrigerator appliance 100 includes a cabinet or housing 102 that extends between a top 104 and a bottom 106 along a vertical direction V, between a first side 108 and a second side 110 along a lateral direction, and between a front 112 and a back 114 along a transverse direction T. Housing 102 may define one or more chilled chambers for receipt of items (e.g., food items) for storage. In some embodiments, housing 102 defines fresh food chamber 122 positioned at or adjacent top 104 of the housing 102 and a freezer chamber 124 arranged at or adjacent bottom 106 of housing 102. As such, refrigerator appliance 100 may generally be referred to as a bottom mount refrigerator.

It is recognized, however, that the benefits of the present disclosure apply to other types and styles of refrigerator appliances such as, for example, a top mount refrigerator appliance, a side-by-side style refrigerator appliance or a standalone ice-maker appliance. Consequently, the description set forth herein is for illustrative purposes only and is not intended to be limiting in any aspect to any particular refrigerator chamber configuration.

Refrigerator doors 128 may be rotatably hinged to an edge of housing 102 for selectively accessing fresh food chamber 122. In addition, a freezer door 130 may be arranged below refrigerator doors 128 for selectively accessing freezer chamber 124. Freezer door 130 may be coupled to a freezer drawer (not shown) slidably mounted within freezer chamber 124. Refrigerator doors 128 and freezer door 130 are shown in the closed configuration in FIG. 1.

In some embodiments, various storage components are mounted within fresh food chamber 122 to facilitate storage of food items therein, as would be understood. In particular, the storage components may include storage bins 116, drawers 118, and shelves 120 that are mounted within fresh food chamber 122. As such, storage bins 116, drawers 118, and shelves 120 are configured for receipt of food items (e.g., beverages or solid food items) and may assist with organizing such food items. As an example, drawers 118 may receive fresh food items (e.g., vegetables, fruits, or cheeses) and increase the useful life of such fresh food items.

Refrigerator appliance 100 may include a water inlet 201. Water may be selectively provided to refrigerator appliance 100 via water inlet 201. For instance, a municipal, local, or external water supply may be coupled to water inlet 201 to provide an external supply of water thereto. Refrigerator appliance 100 may include a water supply valve 202. Water supply valve 202 may be provided at or near water inlet 201. Water supply valve 202 may be operable or controllable between an open position (e.g., allowing water to flow therethrough) and a closed position (e.g., restricting water from flowing therethrough). Accordingly, water supply valve 202 may be operably coupled with a controller 176 (described below).

In some embodiments, refrigerator appliance 100 also includes a dispensing assembly 140 for dispensing liquid water or ice. Dispensing assembly 140 may include a dispenser 142, for example, positioned on or mounted to an exterior portion of refrigerator appliance 100 (e.g., on one of doors 128). Moreover, as shown in FIG. 1, dispenser 142 may include a discharging outlet 144 for accessing ice and liquid water. Further, an actuating mechanism 146, shown as a paddle, may be mounted below discharging outlet 144 for operating dispenser 142. In alternative embodiments, any suitable actuating mechanism may be used to operate dispenser 142. For instance, a dispenser valve 204 may be included within dispenser 142. Dispenser valve 204 may be selectively operated or controlled between an open position (e.g., allowing water to flow therethrough) and a closed position (e.g., restricting water from flowing therethrough). Dispenser valve 204 may be communicatively coupled with controller 176. Accordingly, dispenser valve 204 may be moved between the open position and the closed position according to inputs or signals from controller 176. A user interface panel 148 may also be provided for controlling the mode of operation. For example, user interface panel 148 may include a plurality of user inputs (not labeled), such as a water dispensing button and an ice-dispensing button, for selecting a desired mode of operation such as crushed or non-crushed ice.

Still referring to FIG. 1, discharging outlet 144 and actuating mechanism 146 may be an external part of dispenser 142 and may be mounted in a dispenser recess 150. Dispenser recess 150 may be positioned at a predetermined elevation convenient for a user to access ice or water and enabling the user to access ice without the need to bend-over and without the need to open doors 128. In additional embodiments, dispenser recess 150 is positioned at a level that approximates the chest level of a user.

In further embodiments, as shown in FIG. 2, refrigerator appliance 100 may include a sub-compartment 162 defined on refrigerator door 128. Sub-compartment 162 may be referred to as an "icebox." Further, as shown, sub-compartment 162 extends into fresh food chamber 122 when refrigerator door 128 is in the closed position. Although sub-compartment 162 is shown in door 128, additional or alterative embodiments may include sub-compartment 162 fixed within fresh food chamber 122. In an embodiment, an icemaker 164 and/or an ice storage bin (not shown) may be positioned or disposed within sub-compartment 162. Accordingly, during use, ice may be supplied to dispenser recess 150 (FIG. 1) from the ice making assembly or ice storage bin in sub-compartment 162 on a back side of refrigerator door 128. Icemaker 164 may include an icemaker valve 206. Icemaker valve may be selectively operable or controllable between an open position (e.g., allowing water to flow therethrough) and a closed position (e.g., restricting water from flowing therethrough). Icemaker valve 206 may be communicatively coupled with controller 176. Accordingly, icemaker valve 206 may be moved between the open position and the closed position according to inputs or signals from controller 176.

In additional or alternative embodiments, chilled air from a sealed system (not shown) of refrigerator appliance 100 may be directed into components within sub-compartment 162. For instance, sub-compartment 162 may receive cooling air from a chilled air supply duct 165 and a chilled air return duct 167 (FIG. 2) disposed on a side portion of cabinet 102 of refrigerator appliance 100. In this manner, supply duct 165 and return duct 167 may recirculate chilled air from a suitable sealed cooling system through sub-compartment 162.

In optional embodiments, as shown in FIG. 2, an access door 166 may be hinged to refrigerator door 128. Thus, access door 166 may permit selective access to sub-compartment 162. Any manner of suitable latch 168 may be configured with sub-compartment 162 to maintain access door 166 in a closed position. As an example, latch 168 may be actuated by a user in order to open access door 166 to provide access into sub-compartment 162. Access door 166 may also assist with insulating sub-compartment 162 (e.g., by thermally isolating or insulating sub-compartment 162 from fresh food chamber 122). It is noted that although access door 166 is illustrated in exemplary embodiments, alternative embodiments may be free of any separate access door.

Figure 3:
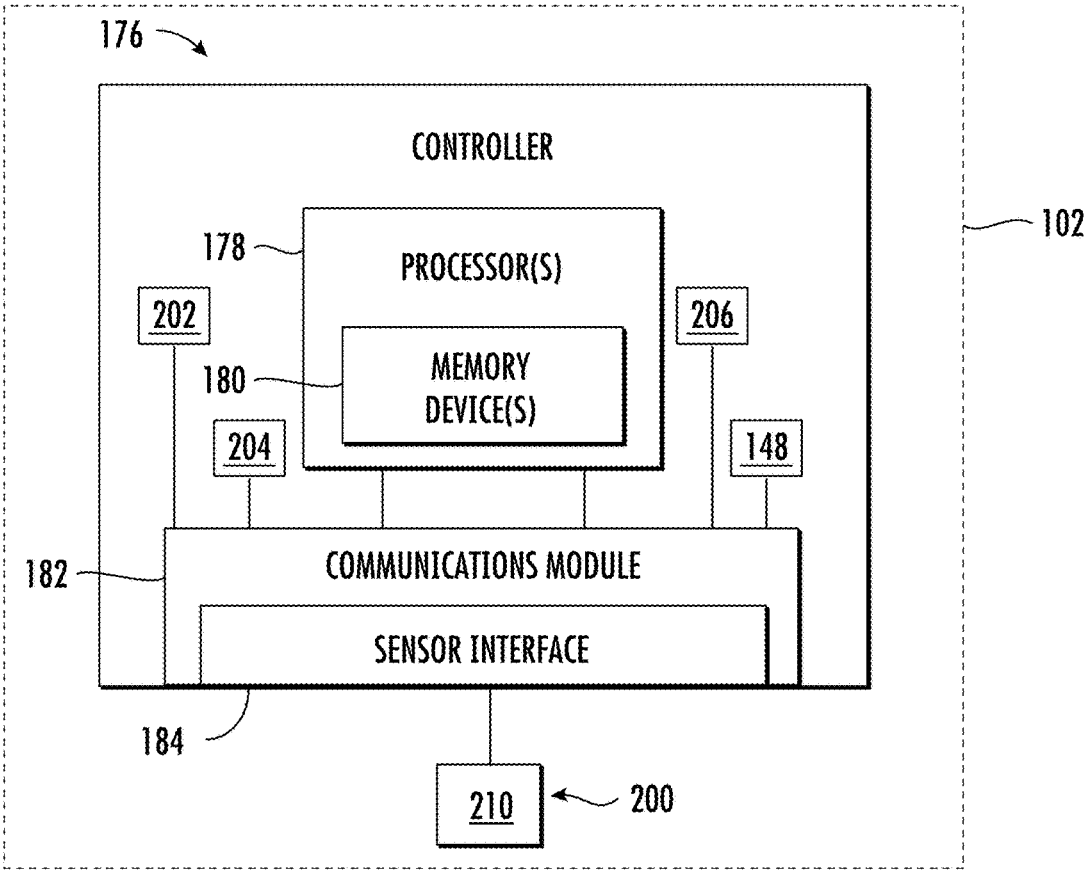
FIG. 3 provides a block diagram of one embodiment of a controller of a refrigerator appliance according to example embodiments of the present disclosure.

Referring particularly to FIG. 3, operation of refrigerator appliance 100 may generally be controlled by a processing device or controller 176. Controller 176 may, for example, be operatively coupled to control panel 148 for user manipulation to select features and operations of refrigerator appliance 100, such a temperature set points. Thus, controller 176 may operate various components of refrigerator appliance 100 to execute selected system cycles, processes, and/or features. In exemplary embodiments, controller 176 is in operative communication (e.g., electrical or wireless communication) with each of the chambers or compartments therein, for example, to regulate temperature as described herein.

More specifically, as shown in FIG. 3, a block diagram of one embodiment of suitable components that may be included within controller 176 in accordance with example aspects of the present disclosure is illustrated. As shown, controller 176 may include one or more processor(s) 178, computer, or other suitable processing unit and associated memory device(s) 180 that may include suitable computer-readable instructions that, when implemented, configure the controller to perform various different functions, such as receiving, transmitting and/or executing signals (e.g., performing the methods, steps, calculations and the like disclosed herein).

As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, memory device(s) 60 may generally include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements.

Such memory device(s) 180 may generally be configured to store suitable computer-readable instructions that, when implemented by processor(s) 178, configure the controller to perform various functions as described herein. Additionally, controller 176 may also include a communications module 182 to facilitate communications between the controller and the various components of refrigerator appliance 100. An interface can include one or more circuits, terminals, pins, contacts, conductors, or other components for sending and receiving control signals. Moreover, controller 176 may include a sensor interface 184 (e.g., one or more analog-to-digital converters) to permit signals transmitted from temperature probe(s) 210 (or any additional or alternative sensors) described herein to be converted into signals that can be understood and processed by processor(s) 178.

As mentioned, refrigerator appliance 100 may include at least one sensor 200. The at least one sensor 200 may be positioned within cabinet 102 of appliance 100. For instance, the at least one sensor 200 may include a flow meter 210. Flow meter 210 may be positioned along water inlet 201. For at least one example, flow meter is positioned at or near water supply valve 202. Thus, as would be understood, flow meter 210 may be configured to sense, measure, calculate, or otherwise determine an amount or volume of water flowing into refrigerator appliance (e.g., into dispenser 142, icemaker 164, etc.). Additionally or alternatively, two or more sensors may be included as certain embodiments warrant, such as for additional flow channels.

As used herein, "flow meter" or the equivalent is intended to refer to any suitable type of flow measuring system or device positioned at any suitable location for measuring the desired flow rate, volume, amount, or the like. Thus, for example, flow meter 210 may be or include any suitable type of flow measuring device, such as a diaphragm, a venturi, a float, an electromagnetic sensor, a vortex, an ultrasonic sensor, etc. In addition, flow meter 210 may be positioned at any suitable location and may output a signal, such as a voltage, to a controller (e.g., controller 176) that is proportional to or indicative of the flow or flow rate being measured. Although exemplary positioning of flow rate sensors is described herein, it should be appreciated that appliance 100 may include any other suitable number, type, and position of flow meters or other sensors according to alternative embodiments.

Figure 4:
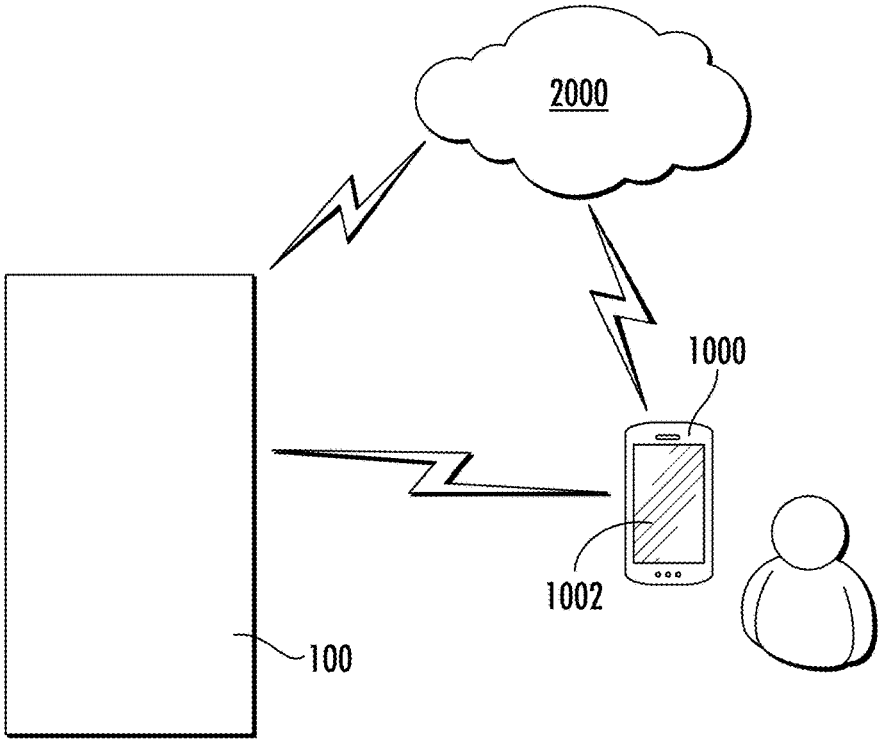
FIG. 4 provides a schematic illustrating a network connection between the refrigerator appliance of FIG. 1, a remote device, and a remote network.

FIG. 4 schematically illustrates refrigerator appliance 100 communicating with a remote user interface device 1000. Also shown (but not numbered) in FIG. 4 is a user such as may interact with the remote user interface device 1000, e.g., via a user interface 1002 of the remote user interface such as a touchscreen in the illustrated embodiment. For example, the remote user interface device 1000 may be a device such as a cell phone, smart phone, smart assistant, laptop computer, wearable device, smart home system, or any similar device in operative communication with controller 176 via a wireless connection. As shown in FIG. 4, refrigerator appliance 100, and in particular, controller 176 thereof, may be configured to communicate with a separate device external to appliance 100, such as a communications device or other remote user interface device 1000. Refrigerator appliance 100 may include a network communication module, e.g., a wireless communication module, for communicating with the remote user interface device 1000. In various embodiments, a network communication module may include a network interface such that controller 176 of refrigerator appliance 100 can connect to and communicate over one or more networks with one or more network nodes. A network communication module may also include one or more transmitting, receiving, or transceiving components for transmitting/receiving communications with other devices communicatively coupled with refrigerator appliance 100. The network communication module may be in communication with, e.g., coupled or connected to, controller 176 to transmit signals to and receive signals from controller 176.

As schematically illustrated in FIG. 4, refrigerator appliance 100 may be configured to communicate with the remote user interface device 1000 either directly or through a network 2000 (e.g., a smart home network). Thus, in various embodiments, refrigerator appliance 100 and remote user interface 1000 may be configured to communicate wirelessly with each other or with network 2000. Network 2000 may be or include various possible communication connections and interfaces, e.g., such as Zigbee, BLUETOOTH®, WI-FI®, or any other suitable communication connection. The remote user interface device 1000 may include a memory for storing and retrieving programming instructions. For example, the remote user interface device 1000 may be a smartphone operable to store and run applications, also known as "apps," and may include a remote user interface provided as a smartphone app. Additionally or alternatively, multiple remote user interface devices 1000 may be connected with refrigerator appliance 100. For instance, one or more smart phones, one or more smart assistant devices (smart speakers), or the like may be simultaneously connected with refrigerator appliance 100 (e.g., through network 2000).

Figure 5:
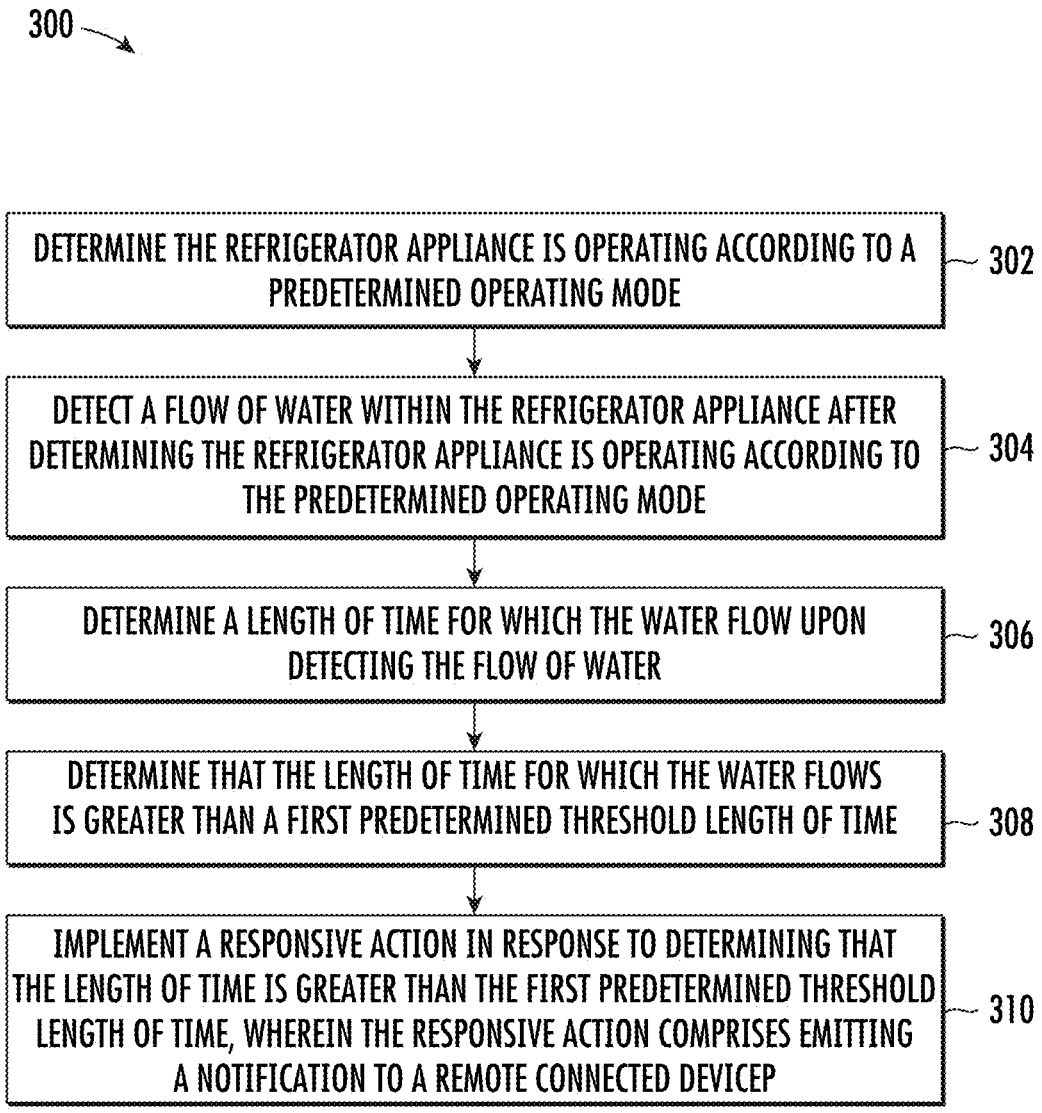
FIG. 5 provides a flow chart illustrating a method of operating a refrigerator appliance according to example embodiments of the present disclosure.

Now that the general descriptions of an exemplary appliance have been described in detail, a method 300 of operating an appliance (e.g., refrigerator appliance 100) will be described in detail. Although the discussion below refers to the exemplary method 300 of operating refrigerator appliance 100, one skilled in the art will appreciate that the exemplary method 300 is applicable to any suitable domestic appliance capable of performing a cooling operation (e.g., such as a freezer, an icemaker, etc.). In exemplary embodiments, the various method steps as disclosed herein may be performed by controller 176 and/or a separate, dedicated controller. FIG. 5 provides a flow chart illustrating a method of operating a refrigerator appliance. Hereinafter, method 300 will be described with specific reference to FIG. 5.

At step 302, method 300 may include determining the refrigerator appliance is operating according to a predetermined operating mode. For instance, a controller (e.g., controller 176) may determine that the appliance (e.g., refrigerator appliance 100) has been placed into a specific operating mode. A user may adjust one or more control programs or operational parameters of the appliance according to a requested mode. According to at least some embodiments, the predetermined operating mode is a vacation mode. The vacation mode may be indicative of an extended period of time for which the appliance may be idle, unused, or otherwise unmanipulated. Accordingly, the vacation mode may assume that doors (e.g., refrigerator doors 128, freezer door 130, etc.) may not be opened while the appliance is in the predetermined (vacation) mode, and that little or no water is to be supplied to the refrigerator appliance (e.g., via the water inlet). Thus, during the predetermined (vacation) mode, the controller may assume no water is to be supplied to the appliance.

At step 304, method 300 may include detecting a flow of water within the refrigerator appliance after determining the refrigerator appliance is operating according to the predetermined operating mode. In detail, after the appliance is confirmed to be operating according to the predetermined operating mode (e.g., vacation mode), the at least one sensor (e.g., flow meter 210) may detect or measure any water flowing into the appliance via the water inlet, the water supply valve, or the like. The detected water flow may be determined to be an abnormal or unexpected water flow within the appliance.

According to some embodiments, the predetermined operating mode (e.g., vacation mode) may include one or more selectable settings. For instance, the predetermined operating mode may initially deactivate or disable certain features of the appliance. For example, the predetermined operating mode may disable a dispenser (e.g., drinking water dispenser), an icemaker, a water filter, or the like. Accordingly, any associated water valves (e.g., dispenser valve 204, icemaker valve 206) may be adjusted to the closed position to restrict water from flowing to the associated features (e.g., dispenser, icemaker, etc.). Additionally or alternatively, a user may select to enable one or more of the features while the appliance is in the predetermined operating mode. Thus, the dispenser, the icemaker, or the like may be enabled during the predetermined operating mode and thus may receive water on demand. Accordingly, at step 304, method 300 may determine whether the water flowing into the appliance is associated with a function of an enabled feature, such as a dispensation of water, a filling of the icemaker, etc.

At step 306, method 300 may include determining a length of time for which the water flows upon detecting the flow of water. For instance, upon detecting that water is flowing through the at least one sensor (e.g., flow meter), a timer may be initiated. The timer may be initiated within the controller. The timer may then be terminated upon determining that the water is no longer flowing through the sensor. the controller may then calculate the total time for which the water was flowing. Additionally or alternatively, method 300 may determine a volume or amount of water that has been supplied to the appliance. For instance, method 300 may calculate the volume of water based on the active time of the sensor and a known flow rate of water at the sensor.

At step 308, method 300 may include determining that the length of time for which the water flows is greater than a first predetermined threshold length of time. In detail, method 300 may compare the total length of time against the first predetermined threshold (or a first determined volume against a first threshold volume). The comparison of the determined length of time against the first predetermined threshold may be made while the water is still flowing. For instance, method 300 may compare the length of time (or volume) as the water is still flowing. In additional or alternative embodiments, the comparison of the total length of time against the first predetermined threshold length of time is made when the water ceases to flow (e.g., as detected by the at least one sensor).

The first predetermined threshold length of time may be set by a user or preprogrammed into the appliance. In some embodiments, the first predetermined threshold length of time may be between about 1 second and about 10 seconds. As mentioned above, when the appliance is operating according to the predetermined operating mode (vacation mode), one or more water valves associated with the appliance may be in the closed state.

According to some embodiments, method 300 may include determining that at least one of an icemaking mode or a dispenser mode is enabled after detecting the flow of water. As mentioned above, while the appliance is operating according to the predetermined operating mode, one or more features, such as the icemaking mode or the dispensing mode, may be activated. As would be understood, when at least one mode or feature requiring water is activated, water may be expectedly supplied to the appliance (e.g., to form or make ice shapes, to provide water to a filter, etc.). Thus, method 300 may include determining that the length of time for which the water flows is greater than a second predetermined threshold length of time.

The second predetermined threshold length of time may be greater than the first predetermined threshold length of time. For instance, when the one or more modes or features are active while the appliance is in the predetermined operating mode, method 300 may anticipate a certain amount of water to be supplied to the appliance upon initiation or activation of an associated mode or features. For example, when the icemaking mode is activated, method 300 anticipates the an amount of water greater than a first amount of water associated with the first predetermined threshold length of time will be supplied to the appliance at the initiation of a scheduled icemaking procedure. Accordingly, method 300 may operate according to the second predetermined threshold length of time when at least one mode or feature is activated while the appliance is operating according to the predetermined operating mode.

At step 310, method 300 may include implementing a responsive action in response to determining that the length of time is greater than the first predetermined threshold length of time (or the second predetermined threshold length of time). The responsive action may include emitting a notification, alert, or other message. For instance, the notification may be emitted or delivered to a remote connected device (e.g., a smartphone). Additionally or alternatively, the notification may be emitted or transmitted to a user interface of the appliance (e.g., a display or display screen), a connected smart appliance (e.g., smart speaker, kitchen hub, etc.), or the like. For instance, the alert may be presented to a user via a mobile app (e.g., a push notification), a text message, an email, or the like.

The notification may include an alert that a potential water leak was detected within the appliance. As mentioned, while the appliance is operating according to the predetermined operating mode, some or all water valves (e.g., the water supply valve, the dispenser valve, the icemaker valve, etc.) may be in the closed position. Accordingly, the notification may alert the user that water is unexpectedly flowing into the appliance, potentially signifying an unwanted leak.

In the instance where one or more modes or features are enabled or activated (e.g., dispenser mode, icemaking mode, etc.) while the appliance is operating according to the predetermined operating mode, one or more of the valves (e.g., water supply valve, dispenser valve, icemaker valve, etc.) may be in the open position. Accordingly, in some instances, implementing the responsive action may include adjusting (e.g., automatically) at least one of the valves to the closed position. For instance, implementing the responsive action may automatically adjust the water supply valve to the closed position to prohibit or restrict additional water from being supplied to the appliance. Additionally or alternatively, the dispenser valve, the icemaker valve, and any additional valves within the appliance may be adjusted to the closed position as part of the responsive action. For instance, when the length of time for which the water flows is determined to be greater than the second predetermined threshold length of time, each of the dispenser valve and the icemaker valve may be adjusted to the closed position.

In some embodiments, implementing the responsive action may include adjusting a dispenser user interface (e.g., user interface panel 148) to a locked state. For instance, upon determining that the potential water leak is present, method 300 may lock the user interface positioned at the dispenser to restrict any water dispensation. One or more of control buttons, input devices, or the like may be disabled. Accordingly, no inputs may be received at the user interface (e.g., dispensing inputs, icemaking inputs, ice retrieving inputs, etc.).

In some embodiments, implementing the responsive action may include receiving a command to adjust the at least one valve to the closed position after emitting the notification (e.g., to the remote connected device). As mentioned, the notification may be emitted to a connected device such as a mobile phone via an app. Through the app, the user may input a command to close one or more of the valves within the appliance. For instance, when the one or more modes or features are enabled while the appliance is operating according to the predetermined operating mode, one or more of the valves may (e.g., temporarily) be in the open position. The user may thus instruct the appliance (e.g., via the controller) to adjust one or more of the valves to the closed position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a fresh food chamber and a freezer chamber;

at least one sensor positioned within the cabinet, the at least one sensor being configured to monitor a flow of water into the refrigerator appliance;

at least one water valve positioned within the cabinet, the at least one water valve being adjustable between a closed position and an open position to selectively allow water into the refrigerator appliance; and a controller operably coupled with the at least one sensor, the controller being configured to perform an operation, the operation comprising:

determining the refrigerator appliance is operating according to a predetermined operating mode;

detecting, via the at least one sensor, a flow of water within the refrigerator appliance after determining the refrigerator appliance is operating according to the predetermined operating mode;

determining a length of time for which the water flows upon detecting the flow of water;

determining that the length of time for which the water flows is greater than a first predetermined threshold length of time; and implementing a responsive action in response to determining that the length of time is greater than the first predetermined threshold length of time, wherein the responsive action comprises emitting a notification to a remote connected device.

2. The refrigerator appliance of claim 1, wherein the at least one sensor comprises a flow meter, the flow meter being fluidly coupled to a water inlet to the refrigerator appliance.

3. The refrigerator appliance of claim 2, further comprising:

a dispenser assembly fluidly coupled to the water inlet, the dispenser assembly comprising a dispenser and a dispenser user interface; and an icemaker fluidly coupled to the water inlet, wherein the operation further comprises:

determining that at least one of an icemaking mode or a dispenser mode is enabled after detecting the flow of water; and determining that the length of time for which the water flows is greater than a second predetermined threshold length of time, the second predetermined threshold length of time being greater than the first predetermined threshold length of time.

4. The refrigerator appliance of claim 3, wherein the at least one water valve comprises:

a water supply valve provided at the water inlet;

a dispenser valve provided at the dispenser assembly; and an icemaker valve provided at the icemaker.

5. The refrigerator appliance of claim 4, wherein implementing the responsive action further comprises:

adjusting the water supply valve to the closed position in response to determining that the length of time for which the water flows is greater than the second predetermined threshold length of time.

6. The refrigerator appliance of claim 5, wherein implementing the responsive action further comprises:

adjusting each of the dispenser valve and the icemaker valve to a closed position in response to determining that the length of time for which the water flows is greater than the second predetermined threshold length of time.

7. The refrigerator appliance of claim 3, wherein implementing the responsive action further comprises:

adjusting the dispenser user interface to a locked state.

8. The refrigerator appliance of claim 1, wherein implementing the responsive action further comprises:

receiving a command to adjust the at least one water valve to the closed position after emitting the notification to the remote connected device.

9. The refrigerator appliance of claim 1, wherein the predetermined operating mode is a vacation mode.

10. A method of operating a refrigerator appliance, the refrigerator appliance comprising a cabinet defining a fresh food chamber and a freezer chamber, at least one sensor positioned within the cabinet and configured to monitor a flow of water into the refrigerator appliance, and at least one water valve positioned within the cabinet, the method comprising:

determining the refrigerator appliance is operating according to a predetermined operating mode;

detecting, via the at least one sensor, a flow of water within the refrigerator appliance after determining the refrigerator appliance is operating according to the predetermined operating mode;

determining a length of time for which the water flows upon detecting the flow of water;

determining that the length of time for which the water flows is greater than a first predetermined threshold length of time; and implementing a responsive action in response to determining that the length of time is greater than the first predetermined threshold length of time, wherein the responsive action comprises emitting a notification to a remote connected device.

11. The method of claim 10, wherein the at least one sensor comprises a flow meter, the flow meter being fluidly coupled to a water inlet to the refrigerator appliance.

12. The method of claim 11, wherein the refrigerator appliance further comprises:

a dispenser assembly fluidly coupled to the water inlet, the dispenser assembly comprising a dispenser and a dispenser user interface; and an icemaker fluidly coupled to the water inlet, wherein the method further comprises:

determining that at least one of an icemaking mode or a dispenser mode is enabled after detecting the flow of water; and determining that the length of time for which the water flows is greater than a second predetermined threshold length of time, the second predetermined threshold length of time being greater than the first predetermined threshold length of time.

13. The method of claim 12, wherein the at least one water valve comprises:

a water supply valve provided at the water inlet;

a dispenser valve provided at the dispenser assembly; and an icemaker valve provided at the icemaker.

14. The method of claim 13, wherein implementing the responsive action further comprises:

adjusting the water supply valve to a closed position in response to determining that the length of time for which the water flows is greater than the second predetermined threshold length of time.

15. The method of claim 14, wherein implementing the responsive action further comprises:

adjusting each of the dispenser valve and the icemaker valve to a closed position in response to determining that the length of time for which the water flows is greater than the second predetermined threshold length of time.

16. The method of claim 12, wherein implementing the responsive action further comprises:

adjusting the dispenser user interface to a locked state.

17. The method of claim 10, wherein implementing the responsive action further comprises:

receiving a command to adjust the at least one water valve to a closed position after emitting the notification to the remote connected device.

18. The method of claim 10, wherein the predetermined operating mode is a vacation mode.

* * * * *